US007986905B2

(12) United States Patent
Tsukamoto

(10) Patent No.: US 7,986,905 B2
(45) Date of Patent: Jul. 26, 2011

(54) IMAGE FORMING APPARATUS

(75) Inventor: Yasumasa Tsukamoto, Hino (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 328 days.

(21) Appl. No.: 12/394,584

(22) Filed: Feb. 27, 2009

(65) Prior Publication Data

US 2009/0226217 A1 Sep. 10, 2009

(30) Foreign Application Priority Data

Mar. 4, 2008 (JP) ..... 2008-053283

(51) Int. Cl.
*G03G 15/36* (2006.01)

(52) U.S. Cl. ..... 399/194; 399/407

(58) Field of Classification Search ..... 399/130, 399/177, 182, 183, 187, 190, 194, 407; 156/298, 156/308.02; 264/299
See application file for complete search history.

(56) References Cited

U.S. PATENT DOCUMENTS 5,601,018 A 2/1997 Iimura et al.
7,846,368 B2 * 12/2010 Kito ..... 264/299

FOREIGN PATENT DOCUMENTS

JP 08-011411 A 1/1996

* cited by examiner

*Primary Examiner* — Hoan Tran
(74) *Attorney, Agent, or Firm* — Buchanan Ingersoll & Rooney PC

(57) ABSTRACT

Disclosed an image forming apparatus including: an image forming section to form an image on a sheet based on an input image data; an additional information position instruction section to instruct a position of an additional image indicating additional information to be formed with the image data; a sheet-cutting position instruction section to instruct a sheet-cutting position on the sheet; and a control section to calculate an image formable region where the additional image can be formed based on the sheet-cutting position instructed by the sheet-cutting position instruction section, to set the position instructed by the additional information position instruction section within the image formable region as a position where the additional image is formed, to combine the additional image with the image data at the set position, and to control the image forming section to form the combined image data on the sheet.

6 Claims, 12 Drawing Sheets

*FIG. 7*

| | | |
|---|---|---|
| ABCDE<br>00001234<br>'04/11/31 | ABCDE<br>00001234<br>'04/11/31 | ABCDE<br>00001234<br>'04/11/31 |
| CASE OF LEFT-ALIGN | CASE OF CENTERING | CASE OF RIGHT-ALIGN |

IMAGE FORMING APPARATUS

BACKGROUND

1. Field of the Invention

The present invention relates to an image forming apparatus.

2. Description of Related Art

In recent years, there has been known an image forming apparatus to form an image on a sheet based on image data (input image data) of a document read by a scanner or input image data input from an external information apparatus. This image forming apparatus includes an apparatus to additionally form image (additional image) indicating predetermined additional information such as created date and time and a creator on the sheet.

For example, Japanese Patent Application Laid-Open Publication No. Hei 8-11411 discloses an automatic stamping apparatus to create stamp image based on the number of documents or the number of sheets, and to combine image data of the documents and stamp image data to create print image data to output the print image data on a sheet.

However, if a position of the additional data is determined on the basis of the input image data, the additional image is not printed on a border of the sheet when the input image data is reduced/enlarged or when the input image data is formed on larger sheet than a size of the input image data. Moreover, if the position of the additional image is determined on the basis of a sheet size, when a sheet-cutting is performed after image forming, a part of the sheet where the additional image is formed is cut off, and thereby there is no additional image on a border of the cut sheet.

Therefore, there is a problem that a user needs to adjust an image forming position of the additional image many times so that the position is located at a desired position through a trial and error process when the user can not form the additional image at user's desired position (for example, the border of the sheet), and the usability becomes worse.

SUMMARY

The present invention is achieved in view of above problems, and an object of the present invention is to save troubles of adjusting an image forming position of an additional image indicating additional information to improve the usefulness.

In order to solve at least one of the above problems, an image forming apparatus on which one aspect of the present invention is reflected includes: an image forming section to form an image on a sheet based on an input image data; an additional information position instruction section to instruct a position of an additional image indicating additional information, which additional image is to be formed with the image data; a sheet-cutting position instruction section to instruct a sheet-cutting position on the sheet; and a control section to calculate an image formable region where the additional image can be formed based on the sheet-cutting position instructed by the sheet-cutting position instruction section, to set the position instructed by the additional information position instruction section within the image formable region as a position where the additional image is formed, to combine the additional image with the image data at the set position, and to control the image forming section to form the combined image data on the sheet.

An image forming method reflecting one aspect of the present invention includes: instructing a position of an additional image indicating additional information, which additional image is to be formed with the image data; instructing a sheet-cutting position on the sheet; and calculating an image formable region where the additional image can be formed based on the sheet-cutting position, setting the position instructed by the instructing the position of the additional image indicating the additional information within the image formable region as a position where the additional image is formed, combining the additional image with the image data at the set position, and performing a control to form the combined image data on the sheet.

BRIEF DESCRIPTION OF THE DRAWINGS

The present invention will become more fully understood from the detailed description given hereinbelow and the appended drawings which given by way of illustration only, and thus are not intended as a definition of the limits of the present invention, and wherein:

FIG. 7 is a diagram showing an example of image formation of the additional image.

DETAILED DESCRIPTION OF THE PREFERRED EMBODIMENT

An embodiment of the present invention will be described in detail with reference to drawings below.

Firstly, a configuration will be explained.

Figure 1:
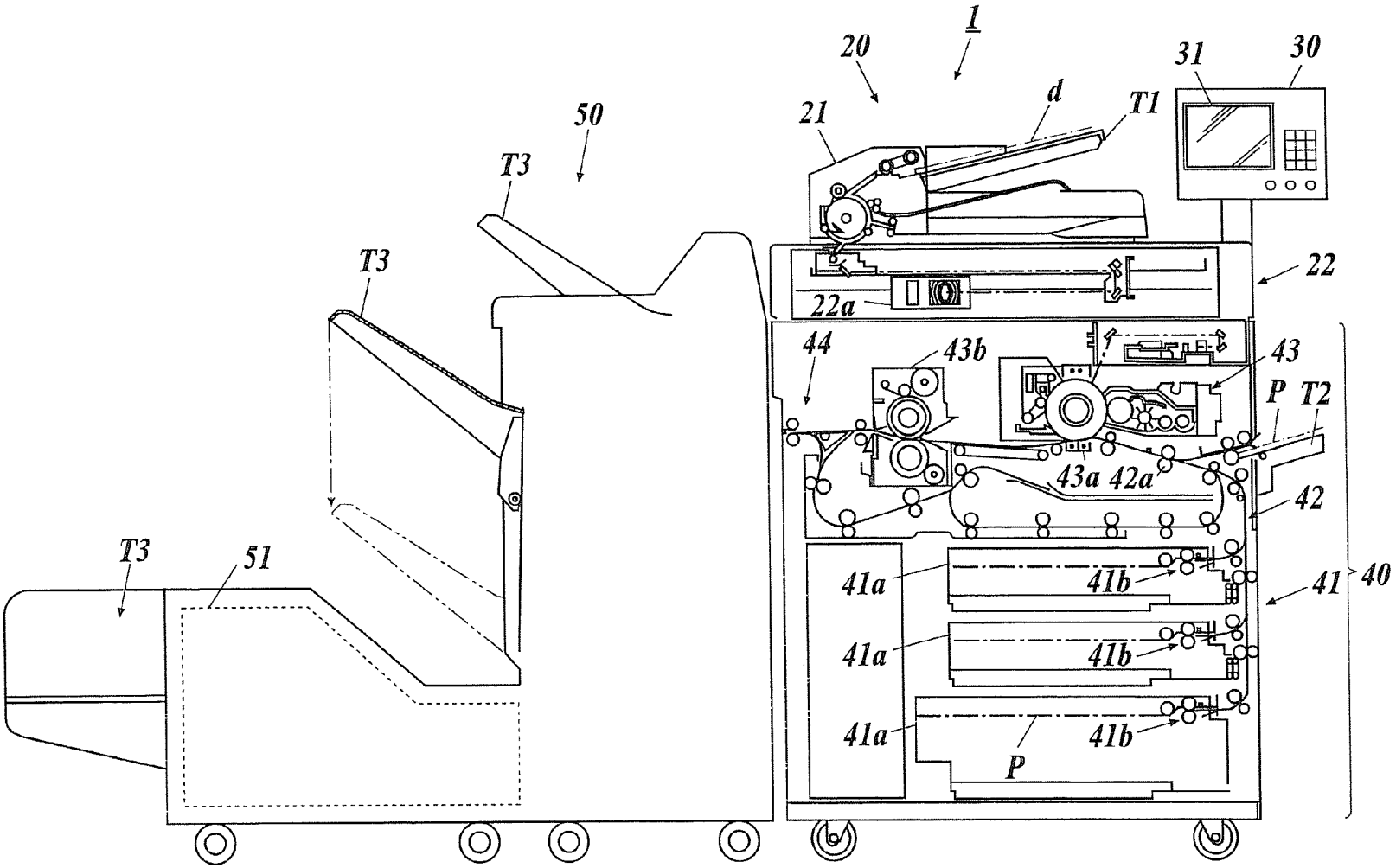
FIG. 1 is a schematic cross-section configuration diagram of an image forming apparatus.

FIG. 1 shows a schematic cross-section configuration diagram of an image forming apparatus 1 according to the embodiment.

As shown in FIG. 1, the image forming apparatus 1 is a digital multifunction peripheral provided with a body section 1*a*, finishing section 50 and the like. The body section 1*a* reads an image from a document to form the read image on a sheet P, and receives page data including image data from an external apparatus and the like or job information for a job including an image forming condition for each pieces of the image data, configuration information such as a finishing condition and the like to form an image on the sheet P based on the received job information. The body section 1*a* includes an image reading section 20, an operation display section 30, a print section 40, and so on. The finishing section 50 performs finishing to the sheet on which the image is formed.

The image reading section 20 includes an auto document sending section 21 termed ADF (Auto Document Feeder) and a reading section 22 to realize a function to read image of a plurality of documents based on the configuration information received by the operation display section 30. A sheet d placed on a document tray T1 of the auto document sending section 21 is transported to a contact glass as a reading point so that an optical system reads an image on one side or both sides of the document d and a CCD (Charge Coupled Device) 22*a* reads the image on the document d. It is intended that the image includes, in addition to image data such as a graphic and a photo, text data such as a character and a mark, and so on.

The image data (analog image signal) read by the image reading section 20 is output to a read processing section 140 in an image control substrate referred to hereinafter, and then the read processing section 140 performs A/D conversion and various image processing to output the image data to the print section 40.

The operation display section 30 is composed of an LCD (Liquid Crystal Display) 31, a touch panel provided so as to cover the LCD 31, and others such as a not-shown operation key. The operation display section 30 receives user's instruction to output an operation signal to a control section 110, and displays various setting screens for inputting various operation instructions and the configuration information, and various processing results according to a display signal input from the control section 110.

Figure 8:
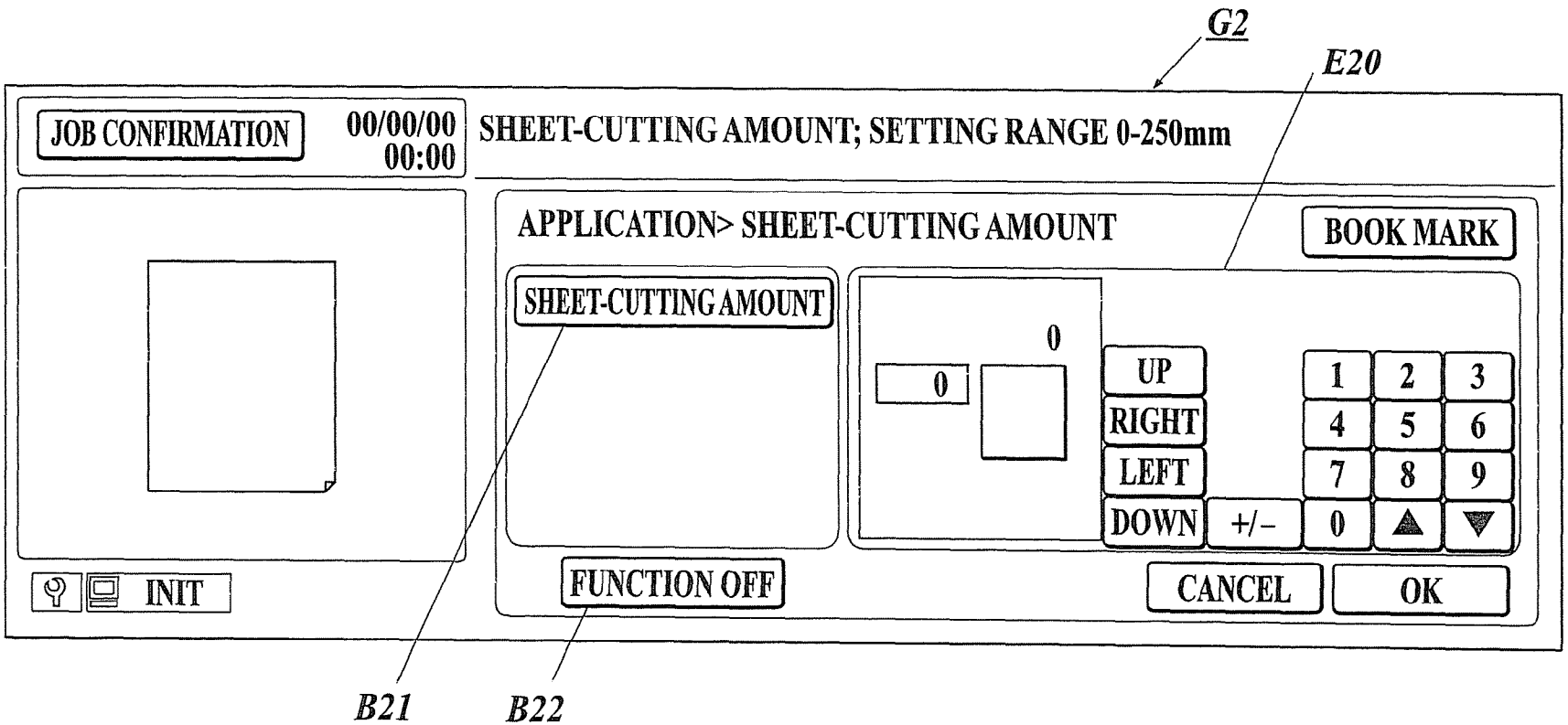
FIG. 8 is a diagram showing an example of a sheet-cutting setting screen.

Moreover, on the LCD 31 of the operation display section 30, various screens such as an additional information setting screen (see FIG. 5) and a sheet-cutting setting screen (see FIG. 8).

The additional information setting screen receives an instruction for a position of an additional image indicating the additional information, which additional image is formed with the input image data. The sheet-cutting setting screen receives an instruction for a sheet-cutting position on the sheet on which the image data of the input image is formed. Moreover, the operation display section 30 receives an instruction whether or not sheet-cutting is performed to the sheet on which the image data of the input image is formed.

The print section 40 performs image forming process by an electrophotographic system based on input print data, and is composed of a sheet feed section 41, a sheet feed transport section 42, an image forming section 43, and a discharge section 44.

The sheet feed section 41 includes a plurality of feed trays 41*a*, a feed member 41*b*, a manual feed tray T2 and the like. Each of the feed trays 41*a* houses sheets P previously identified by kind of sheets, and the feed member 41*b* transports the sheets P one by one from uppermost part to the sheet feed transport section 42.

The manual feed tray T2 can mount various kinds of sheets P according to user's needs, and a feed roller transports the mounted sheets P one by one from uppermost part to the sheet feed transport section 42.

The sheet feed transport section 42 transports the sheets P transported from the feed trays 41*a* or the manual feed tray T2 to a transfer apparatus 43*a* through a plurality of intermediate rollers, a resist roller 42*a* and the like.

Moreover, the sheet feed transport section 42 transports the sheets P on one side of which the image has been formed to both-sides sheet path by a sheet-path switching plate, and transports the sheets P again to the transfer apparatus 43*a* through the plurality of intermediate rollers and the resist roller 42*a*.

The image forming section 43 includes: a photoconductive drum; a charging device; an exposure device which includes a laser output section to output a laser light based on the image data, and a polygon mirror to allow a laser light to scan in main scanning direction; a develop device; a transfer device 43*a*; a cleaning section; and a fixing section 43*b*. The image forming 43 realizes a function to form the image on the sheet based on the job information stored in RAM 130 referred to hereinafter. Specifically, the exposure device irradiates the photoconductive drum charged by the charging device with the laser light to form an electrostatic latent image. Then, the develop device develops the electrostatic latent image by adding charged toner on a surface of the photoconductive drum on which the electrostatic latent image is formed. A toner image formed on the photoconductive drum by the develop device is transferred onto the sheets P by the transfer device 43*a*. Then, the cleaning section removes residual toner and the like on the surface of the photoconductive drum after the toner image is transferred on the sheets P.

The fixing section 43*b* heat-fixes the transferred toner image on the sheets P transported by the feed transport section 42. The heat-fixed sheets P are held by sheet eject rollers of the discharge section 44 to be transported from a discharge entrance to the finishing section 50.

The finishing section 50 includes various finishing units including: a sort section to perform sorting process to the sheet on which the image is formed; a punch section to perform punching process; a staple section to perform stapling process for binding a stack of sheets in set binding direction and at set binding position; a fold section to perform folding process; a sheet-cutting unit 51 to perform sheet-cutting process, and a plurality of sheet eject trays T3 in which the sheet to which various processes are performed or any process are not performed is ejected and mounted.

Figure 2:
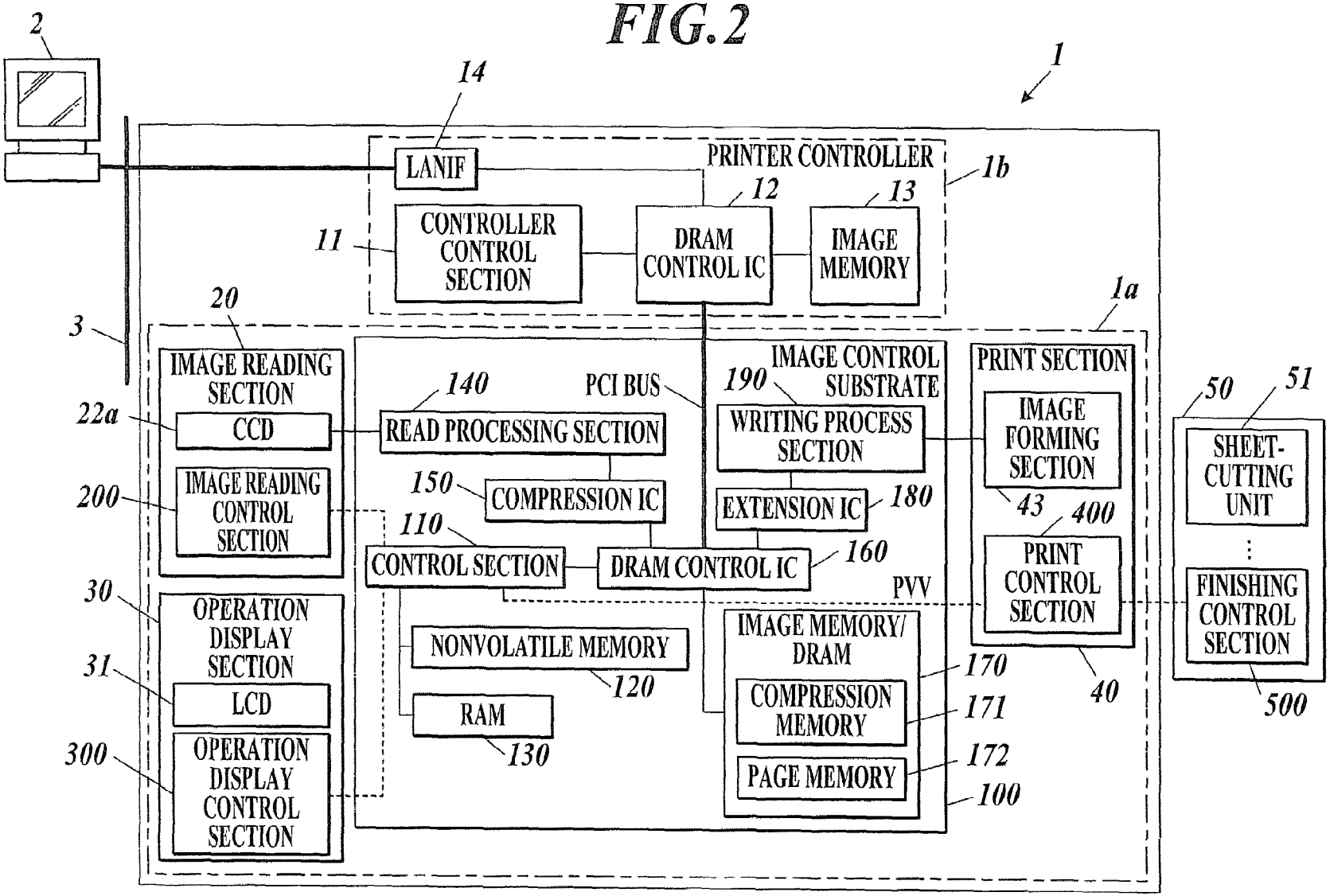
FIG. 2 is a control block diagram of the image forming apparatus.

FIG. 2 shows a control block diagram of the image forming apparatus 1.

As shown in FIG. 2, the image forming apparatus 1 is composed of the body section 1*a*, a printer controller 1*b*, and the finishing section 50 connected to the body section 1*a*. The image forming apparatus 1 is connected to an external apparatus 2 on a network 3 through LANIF (Local Area Network InterFace) 14 of the printer controller 1*b* so as to transmit and receive information to each other.

The body 1*a* includes the image reading section 20, the operation display section 30, the print section 40, and the image control substrate 100. Incidentally, an explanation about each of the sections already explained with respect to FIG. 1 is omitted by adding same numbers thereto.

The image control substrate 100 is composed of the control section 110; a nonvolatile memory 120; a RAM (Random Access Memory) 130; the read processing section 140; a compression IC 150; a DRAM (Dynamic Random Access Memory) control IC 160; an image memory 170; an extension IC 180; and a writing process section 190.

The control section 110 is composed of a CPU (Central Processing Unit) and the like, reads a specified program and data among a system program and various application programs stored in the nonvolatile memory 120 and various pieces of data to expand them in the RAM 130, and executes various processes in cooperation with the program expanded in the RAM 130 to perform central control of each of the sections of the image forming apparatus 1. For example, the control section 110 controls copying, printing, reading of the image data and the like by switching a copy mode, printer mode and scanner mode according to an instruction signal input from the operation display section 30 or the external apparatus 2.

The control section 110 reads an additional image combining process program according to the present embodiment from the nonvolatile memory 120 and reads various pieces of data such as the job information of each job stored in the RAM 130 to execute the additional image combining process in cooperation with the program and various pieces of data.

In the additional image combining process, an image formable region where the additional image can be formed is calculated based on the sheet-cutting position instructed from the touch panel based on a sheet-cutting screen displayed on the LCD 31. Then a position instructed from the touch panel based on the additional information setting screen displayed on the LCD 31 within the image formable region is set as a position (additional image position) where the additional image is formed. The additional image combining process is a process for combining the additional image with the input image at the set position and forming the combined image on the sheet by the image forming section.

The nonvolatile memory 120 stores, in addition to various process programs and data regarding image formation, the additional image combining process program according to the present embodiment, data processed by the various programs, various pieces of additional information, a size of sheet housed in each of the feed trays 41*a* of the feed section 41, and various pieces of data such as a default value of each of the sections.

As a kind of the additional information, there are created date/time, a counter value which is incremented whenever the image is formed on one recording medium, a character string which is specified on the operation display section 30 or optional, and so on.

The additional information of the created data/time includes date notations and time notations such as Western calendar/Japanese calendar, only date/date and time/only time, and 12-hour clock notation/24-hour clock notation. The additional information of the counter value includes output notations where counted value is considered the number of characters or previously-set digit number is considered the number of characters. The additional information of the character string includes the number of characters and a kind of characters such as hiragana, katakana, and English characters/Arabic numerals. Incidentally, various pieces of additional information include a font to be used, a size of the character and a documentary form (vertical writing/horizontal writing).

The RAM 130 forms a work area temporarily storing various programs to be executed by the control section 110, data of these programs, the job information and the like.

The read processing section 140 performs various processes such an analog process, A/D converting process and a shading process to the analog image signal input from an image reading control section 200 of the image reading section 20, and then creates a digital image data. The created image data is output to the compression IC 150.

The compression IC 150 performs compressing process to the input digital image data to output the data to the DRAM control IC 160.

The DRAM control IC 160 controls compressing process of the image data by the compression IC 150 and extending process of the compressed image data by the extension IC 180 according to the instruction from the control section 110, and controls input/output of the image data to/from the image memory 170.

For example, when an instruction to store the image signal read by the image reading section 20 is received, the DRAM control IC 160 allows the compression IC 150 to perform compressing process of the image data input from the read processing section 140, and allows a compression memory 171 of the image memory 170 to store the compressed image data. Then, when an instruction to print/output the compressed image data stored in the compression memory 171 is received, the compressed image data is read from the compression memory 171 and extended by the extension IC 180 to be stored in a page memory 172. After that, when an instruction to print/output of the image data stored in the page memory 172 is received, the image data is read from the page memory 172 to be output to the writing process section 190.

The image memory 170 includes the compression memory 171 and the page memory 172 which are composed of DRAM (Dynamic RAM). The compression memory 171 is a memory for storing the compressed image data, the page memory 172 is a memory for temporarily storing the image data (print data) for printing/outputting.

The extension IC 180 performs extending process to the compressed mage data.

The writing process section 190 creates the print data for image formation based on the image data input from the DRAM control IC 160 to output the print data to the print section 40.

The image reading section 20 is composed of the CCD 22*a* and the image reading control section 200, and additionally, the auto document sending section 21, the reading section 22 and the like which are not shown here but shown in FIG. 1. The image reading control section 200 controls the auto document sending section 21, the reading section 22 and the like to perform scan exposure on document surface so that the CCD 22*a* performs photoelectric conversion of reflected light to read the image. The read analog image signal is output to the read processing section 140.

The operation display section 30 is composed of the LCD 31 and an operation display control section 300, and additionally, an operation key group such as a touch panel and a numeric keypad which are not shown. The operation display control section 300 allows the LCD 31 to display various setting screens for inputting various setting conditions, various screens shown in FIGS. 5 and 8, various processing results, and so on. Moreover, the operation display control section 300 outputs the operation signal input from the operation key group or the touch panel to the control section 110.

The print section 40 is composed of each sections for printing/outputting such as the image forming section 43 shown in FIG. 1 and a print control section 400. The print control section 400 controls an operation of each of the sections of the print section 40 such as the image forming section 43 according to the instruction from the control section 110 to form the image on the sheet P based on the print data input from the writing process section 190, and outputs the instruction signal to operate each section of the finishing section 50 to the finishing control section 500 according to the instruction from the control section 110.

The finishing section 50 includes various finishing units such as a sort unit, a punch unit, staple unit, a fold unit and the sheet-cutting unit 51, and is provided with a transport member such as a transport roller for transporting the sheet P to various finishing units. Each of the units of the finishing section 50 is controlled intensively by the finishing control section 500. The finishing control section 500 transports the sheets P along the sheet path to the predetermined unit according to the instruction signal for finishing input from the control section 110 through the print control section 400, and drives/controls each of the units to perform predetermined finishing to the sheets P to discharge them to the predetermined eject tray.

Next, each section of the printer controller 1*b* will be described. The printer controller 1*b* manages and controls the job input from the external apparatus 2 connected to the network 3 to the image forming apparatus 1 when the image forming apparatus 1 is used as a network printer. The printer controller 1*b* receives the data to be printed from the external apparatus 2 to transmit the data as the job to the body section 1*a*.

The printer controller 1*b* is composed of a controller control section 11, a DRAM control IC 12, an image memory 13 and a LANIF 14.

The controller control section 11 intensively controls an operation of each section of the printer controller 1*b*, and transmits the data input from the external apparatus 2 as the job to the body section 1*a* through the LANIF 14.

The DRAM control IC 12 controls storage of the data received by the LANIF 14 into the image memory 13 and read of the data from the image memory 13. Moreover, the DRAM control IC 12 is connected to the DRAM control IC 160 of the image forming substrate 100 through a PCI (Peripheral Components Interconnect) bus, and reads the data to be printed from the image memory 13 to output the data to the DRAM control IC 160 according to the instruction from the controller control section 11.

The image memory 13 is composed of DRAM and temporarily stores the input data to be output.

The LANIF 14 is a communication interface to be connected to the network 3 including LAN such as a NIC (Network Interface Card) and a modem, and receives the data from the external apparatus 2. The received data is output to the DRAM control IC 12.

Figure 3:
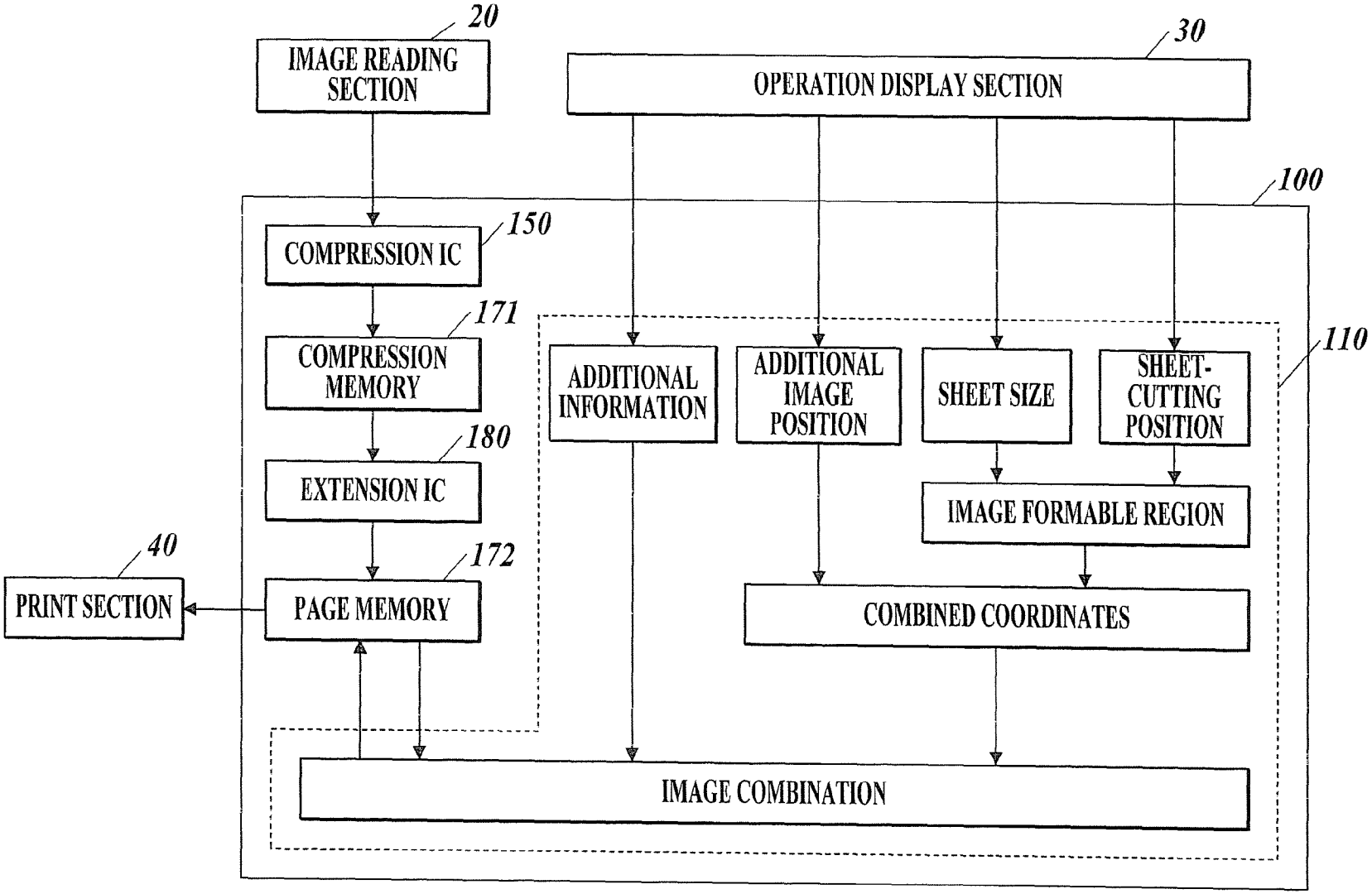
FIG. 3 is a functional configuration diagram of the image forming apparatus when an additional image combining process is performed.

FIG. 3 shows a functional configuration diagram of the image forming apparatus when the additional image combining process according to the present embodiment is performed. An outline of the additional image combining process will be described.

As shown in FIG. 3, the control section 110 receives an instruction to start image formation including the sheet size corresponding to a kind of the sheet on which the image data is formed, the sheet-cutting position on the sheet, the additional information to be formed with the image data, the position (additional image position) of the additional image indicating the additional information and the like from the operation display section 30. Then, the control section 110 reads the image data input from the image reading section 20 or the printer controller 1*b*, compresses/extends the image data with the compression IC, the compression memory 171 and the extension IC 180, and stores the image data (print data) necessary for forming the image on the sheet based on the read image data into the page memory 172.

Moreover, the control section 110 calculates the image formable region where the additional image can be formed based on the sheet size and the sheet-cutting position received from the operation display section 30. The control section 110 calculates the additional image position in the image formable region as a position (combined coordinates) in which the additional image is formed. The control section 110 combines the image data (namely, original image data of the additional image) for forming the image of the additional information and the image data stored in the page memory 172 based on the calculated coordinates. The control section 110 outputs the combined image data to the print section 40 to perform image formation.

Next, an operation according to the present embodiment will be described.

Figure 4:
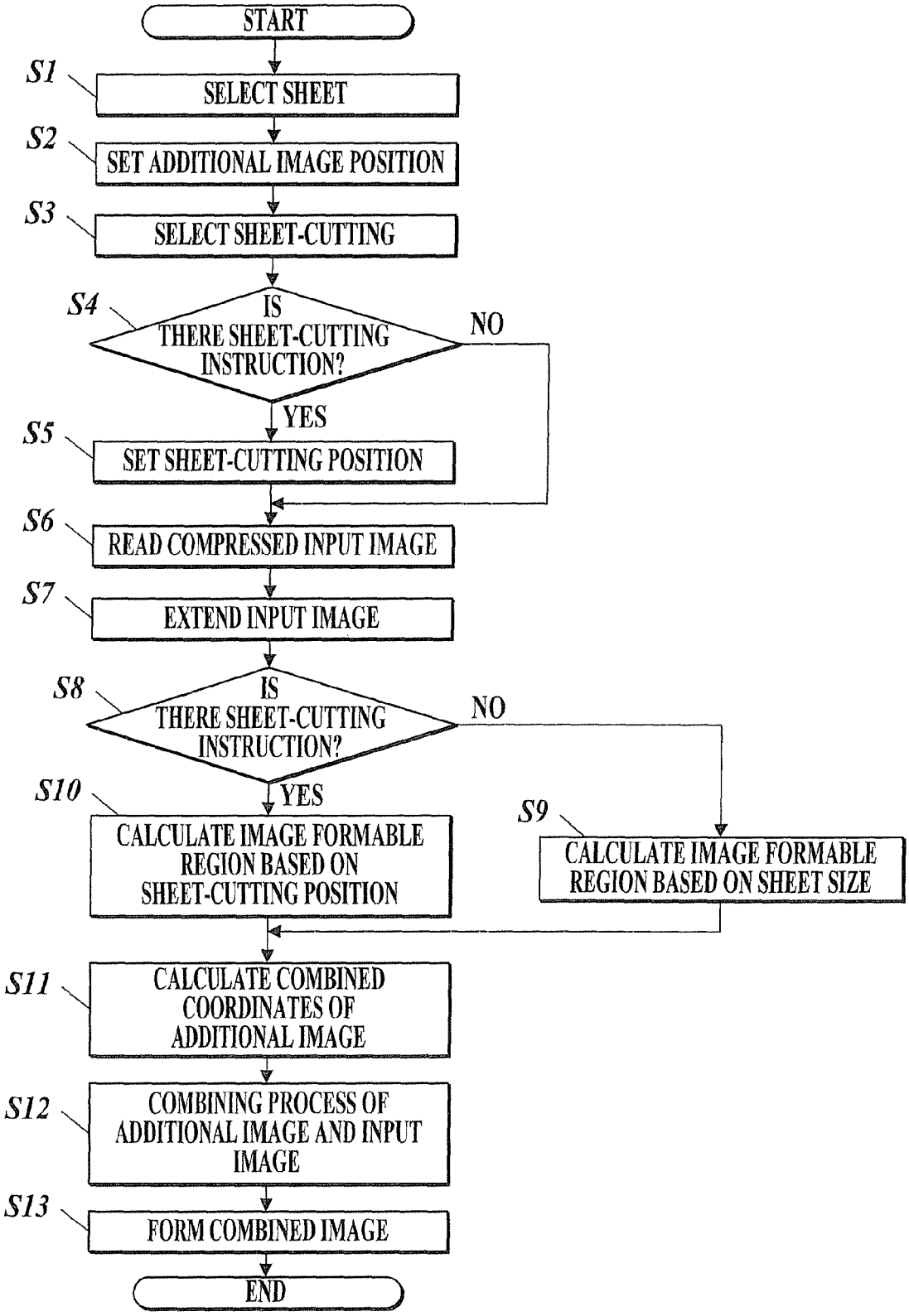
FIG. 4 is a flowchart of the additional image combining process.

FIG. 4 shows a flowchart of the additional image combining process according to the present embodiment. This process is performed by the control section 110 in cooperation with each of the sections.

The control section 110 receives, by the operation display section 30, the instruction to select the sheet on which the input image is formed based on the image data input from the image reading section 20 or the printer controller 1*b* (Step S1). The control section 110 obtains the sheet size corresponding to a kind of the sheet instructed to be selected from the nonvolatile memory.

Figure 5:
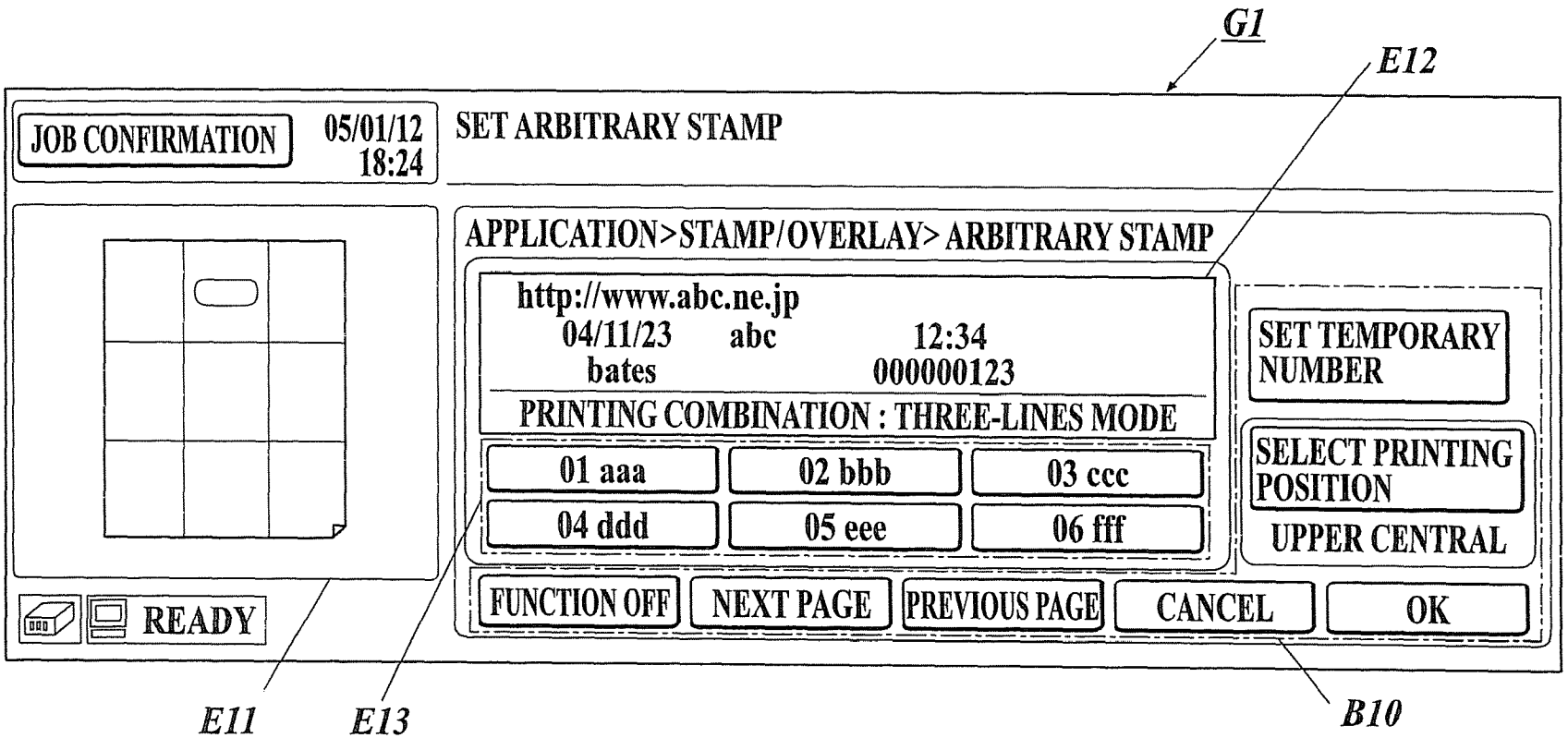
FIG. 5 is a diagram showing an example of an additional information setting screen.

The control section 110 receives, by the operation display section 30, the instruction on the position (additional image position) of the additional image indicating the additional information, which additional image is formed with the image data of the input image, and the information about a kind of the additional information or a content of the kind of the additional information (Step S2). In Step 2, the information (contents of the additional image position or a kind of the additional information) regarding the additional information is received based on an operation of the touch panel based on an additional information setting screen G1 displayed on the LCD 31 of the operation display section 30. FIG. 5 shows an example of the additional information setting screen G1.

As shown in FIG. 5, the additional information setting screen G1 includes an additional image position specifying region E11, an additional information setting region E12, an additional information selecting region E13, and a function button group B10.

The additional image position specifying region E11 is a region for receiving an input of a position of the additional image indicating the additional information. The additional image position specifying region E11 displays an image where the calculated image formable region is divided into nine, and receives a selection of the region where the additional image is formed among nine divided regions. The additional information setting region E12 is a region for displaying a content regarding the additional information such as an example of the additional image based on the additional information. The additional information selecting region E13 is a region for selecting a kind or a content of the additional information, which is previously registered. The function button group B10 is a plurality of various buttons for selecting various functions such as registering a kind or a content of the additional information on the additional information selecting region E13 or determining the additional information. Therefore, the additional information setting screen G1 and the touch panel function as an additional information position instruction section.

Incidentally, the specification of the position of the additional image can be performed by, in addition to selecting the region by the additional image position specifying region E11, specifying an adjusting direction or a distance to fine adjust a printing position in the selected region.

Figure 6:
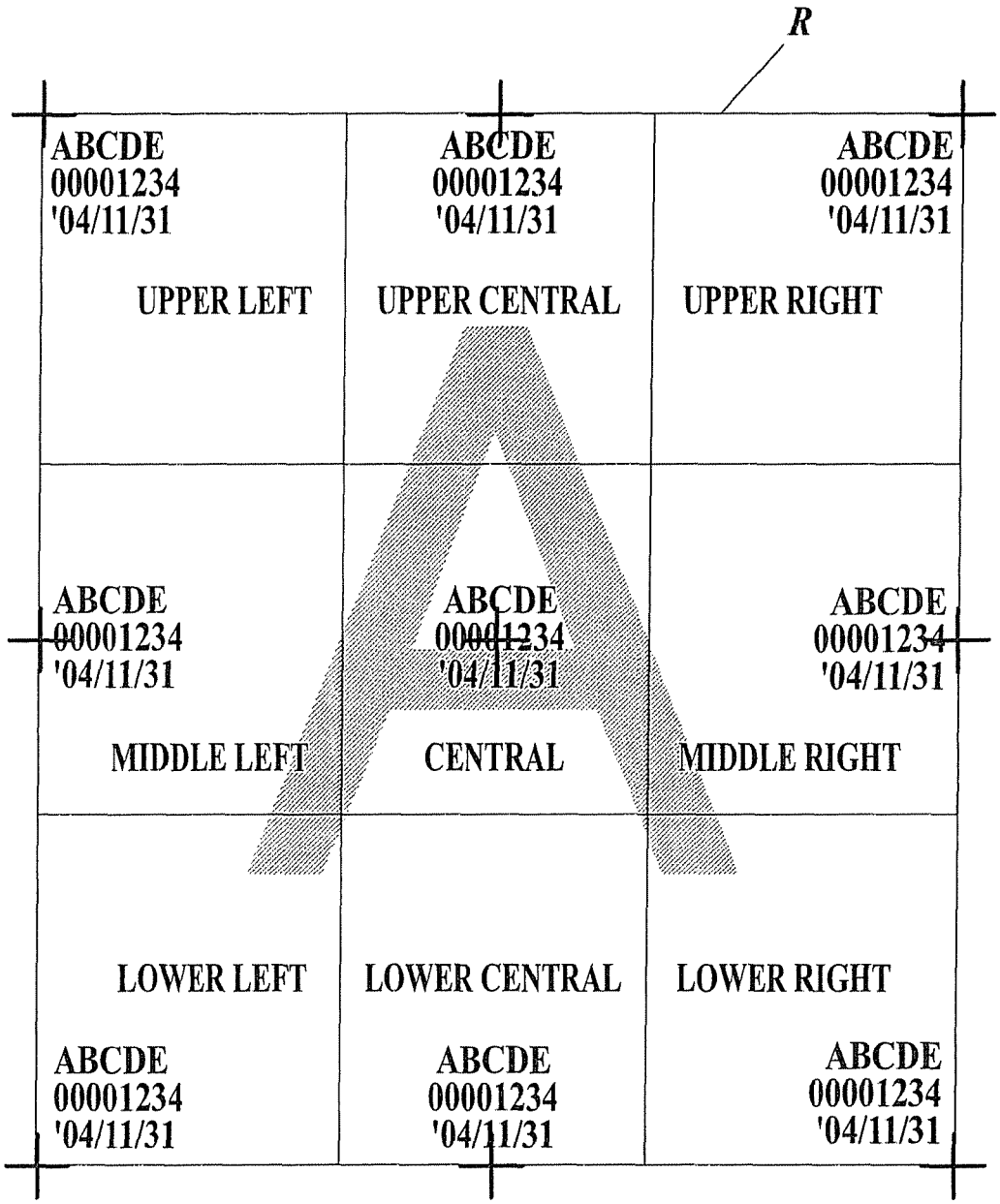
FIG. 6 is a diagram showing an example of the image forming position of the additional image with respect to an image formable region.

FIG. 6 shows an example of an image forming position of the additional image with respect to the image formable region. By specifying the information regarding the additional information in Step S2, as shown in FIG. 6, the additional image can be formed in a desired region which is "upper left", "upper center", "upper right", "middle left", "center", "middle right", "lower left", "lower center", or "lower right" of the calculated image formable region R.

Moreover, in the selected region among the nine divided regions, a specification of a detail position where the additional image is formed or a specification of the content can be performed. Incidentally, image formation of the additional image can be performed by selecting one of the nine divided regions, and also by selecting a plurality of regions.

Furthermore, FIG. 7 shows an example of image formation of the additional image indicating the additional information.

A format of the additional information may be any one of "left-align", "center" and "right-align", as shown in FIG. 7. This format is a configuration where "left-align" is the case that the left region is selected in the image formable region R, "center" is the case that the center region is selected, and "right-align" is the case that the right region is selected.

Moreover, the format may be changed according to the selected region. A configuration where setting of the format of the additional image is performed by the function button group B10 on aforementioned additional information setting screen G1 in FIG. 5 may be adopted.

The control section 110 receives, by the operation display section 30, an instruction to select whether or not sheet-cutting is performed to the sheet on which the image data of the input image is formed (Step S3), and determines whether or not the instruction to perform sheet-cutting is received (Step S4).

When the operation display section 30 receives the instruction to perform sheet-cutting (Step S4; Yes), the control section 110 receives the instruction on the sheet-cutting position on the sheet (Step S5). The sheet-cutting position in Step S5 is a position based on a sheet-cutting amount or a position of a mark (register mark) indicating the sheet-cutting position.

The receptions of the instruction to select whether or not sheet-cutting is performed and the sheet-cutting position in Steps S3 and S5 are performed based on an operation of the touch panel based on a sheet-cutting setting screen G2 displayed on the LCD 31 of the operation display section 30. FIG. 8 shows an example of the sheet-cutting setting screen G2 which receives the instruction on the sheet-cutting amount as the sheet-cutting position.

As FIG. 8 shows, the sheet-cutting setting screen G2 includes a sheet-cutting selection button B21, a release button B22, and a sheet-cutting amount setting region E20.

The sheet-cutting selection button B21 shows a status of receiving the instruction to perform sheet-cutting and enables the operation instruction in the sheet-cutting amount setting region E20 when the sheet-cutting selection button B21 is selected, and shows a status of receiving the instruction not to perform sheet-cutting when the sheet-cutting selection button B21 is not selected. The release button B22 is a button for releasing a status that the sheet-cutting selection button B21 is selected, in other words, for putting it back to a condition that the sheet-cutting selection button B21 is not selected. The sheet-cutting amount setting region E20 is a region for receiving the instruction of the sheet-cutting amount from end of the sheet. The control section 110 calculates and sets the sheet-cutting position of the sheet based on the instruction on the sheet-cutting amount from end of the sheet.

Moreover, the control section 110 sets a register mark position as the sheet-cutting position when the register mark position is set by the operation of the touch panel based on various screens including a setting button for setting existence or nonexistence of the register mark displayed on the LCD 31 of the operation display section 30 and setting region of the register mark position.

Therefore, the sheet-cutting selection button B21 or the setting button of existence or nonexistence of the register mark and the touch panel function as a sheets cutting instruction section, and the sheet-cutting setting screen G2 or the screen including the setting region of the register mark position and the touch panel function as a sheet-cutting position instruction section.

Incidentally, the order of processes of Step S1, Step S2, Steps S3-S5 is not limited to above-described order, and may be any orders as long as the processes are performed before Step S6 starts to be performed.

When the instruction to perform the sheet-cutting process is not received (Step S4; No), or after Step S5, the control section 110 reads the image data of the input image compressed and stored in the compression memory 171 (Step S6), extends the image data in the extension IC 180 (Step S7), and stores the image data in the page memory 172.

The control section 110 judges whether or not there is the sheet-cutting instruction with respect to the sheet on which the image of the read image data is formed (Step S8), and when there is not the sheet-cutting instruction (Step S8; No), calculates the sheet size as the image formable region (Step S9).

When there is the sheet-cutting instruction (Step S8; Yes), the control section 110 calculates the sheet size after sheet-cutting based on the sheet-cutting position as the image formable region (Step S10).

Figure 9A:
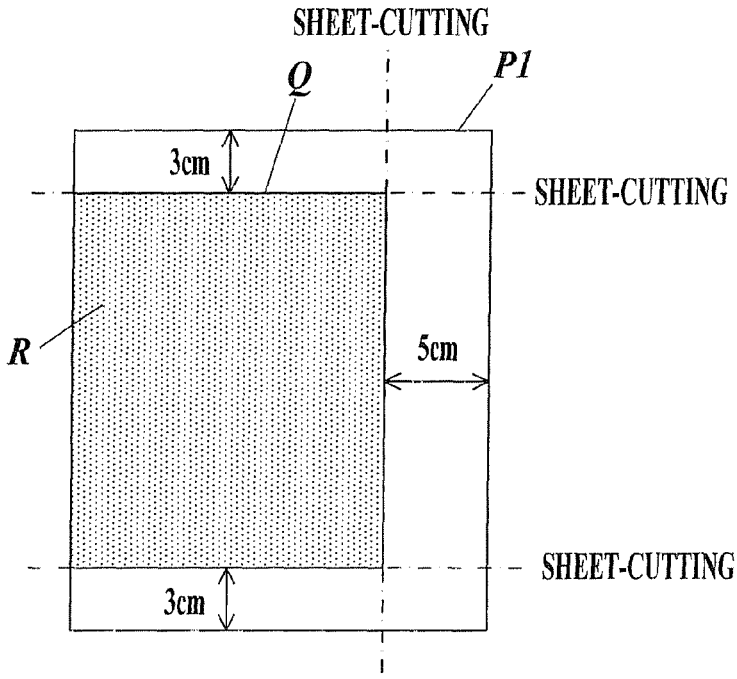
FIG. 9A is a diagram showing an example of an image formable region R in the case where a sheet-cutting amount is specified as a sheet-cutting position.
Figure 9B:
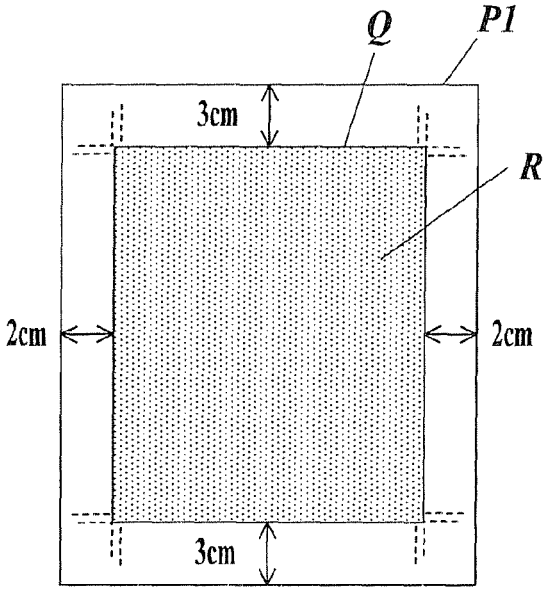
FIG. 9B is a diagram showing an example of the image formable region R in the case where a register mark position is specified as the sheet-cutting position.
Figure 10:
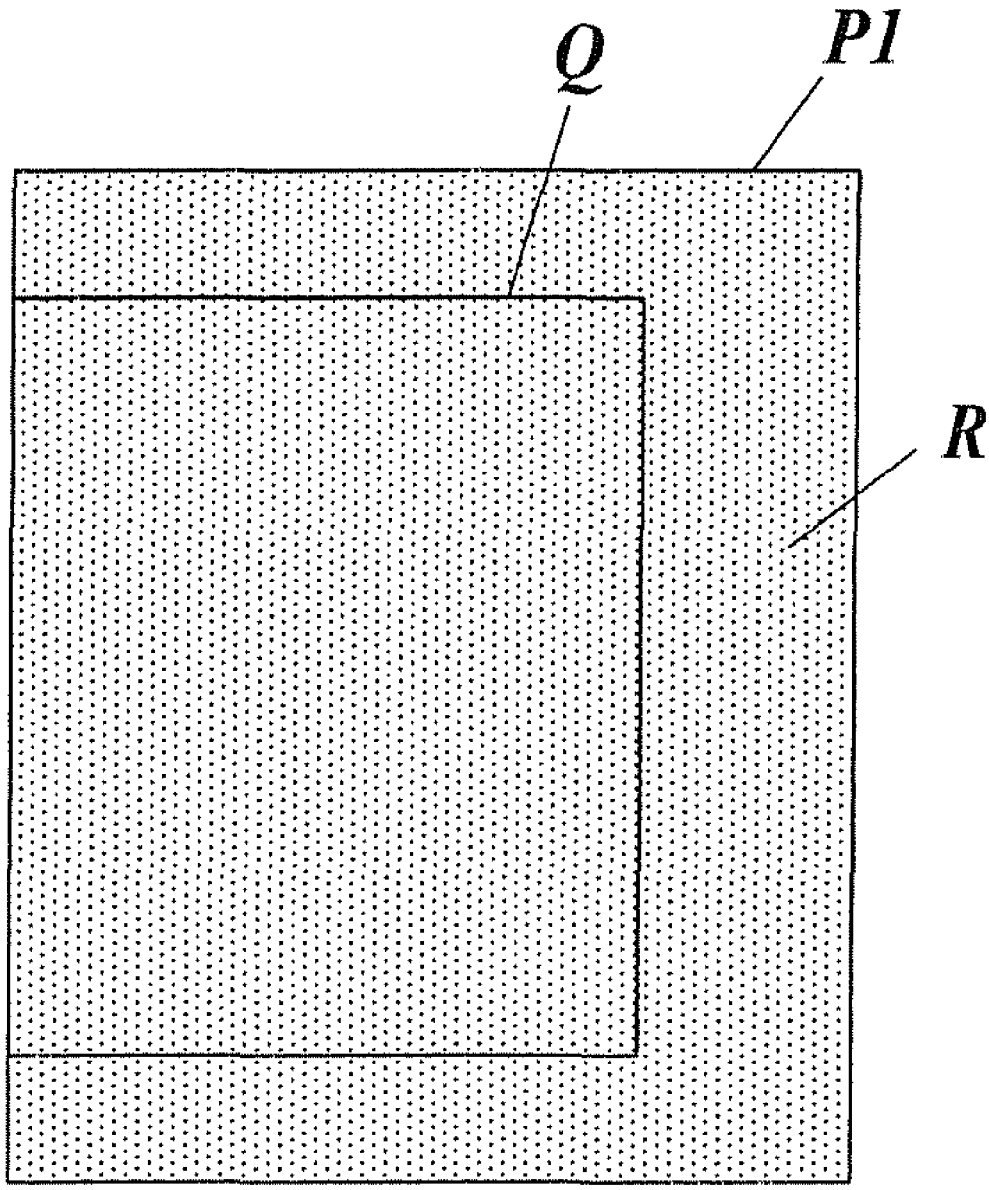
FIG. 10 is a diagram showing an example of the image formable region R in the case where there is no sheet-cutting instruction.

FIG. 9A shows a diagram showing an example of the image formable region R in the case where the sheet-cutting amount is specified as the sheet-cutting position, FIG. 9B shows a diagram showing an example of the image formable region R in the case where the register mark position is specified as the sheet-cutting position, and FIG. 10 is a diagram showing an example of the image formable region R in the case where there is no sheet-cutting instruction. Incidentally, it is assumed that a size of an input image Q and a size of a specified sheet P1 are different from each other.

FIG. 9A shows an example where the sheet-cutting amount is set so that the sizes of the input image Q and the sheet size after sheet-cutting are almost same, and a size (shaded region) of the specified sheet cut 3 cm from both ends in longitudinal direction and 5 cm from one end in transverse direction is calculated as the image formable region R.

FIG. 9B shows an example where the sheet-cutting amount is set so that the sizes of the input image Q and size of the region surrounded based on the register mark position are almost same, and a size (shaded region) of the specified sheet cut 3 cm from both ends in longitudinal direction and 2 cm from both ends in transverse direction is calculated as the image formable region R.

On the other hand, FIG. 10 shows an example where there is no sheet-cutting instruction, and the size (shaded region) of the sheet P1 is calculated as the image formable region R.

After Step S9 and Step 10, the control section 110 calculates the combined coordinates of the additional image based on the calculated image formable region and the additional image position (Step S11). The control section 110 generates the image data based on the additional information to be the additional image, and combines the image data with the image data to be the input image stored in the page memory 172 based on the combined coordinates (Step S12). The control section 110 outputs the combined image data to the print section 40, forms the image (combined image) based on the combined image data on the sheet (Step S13), and ends the process.

Figure 11:
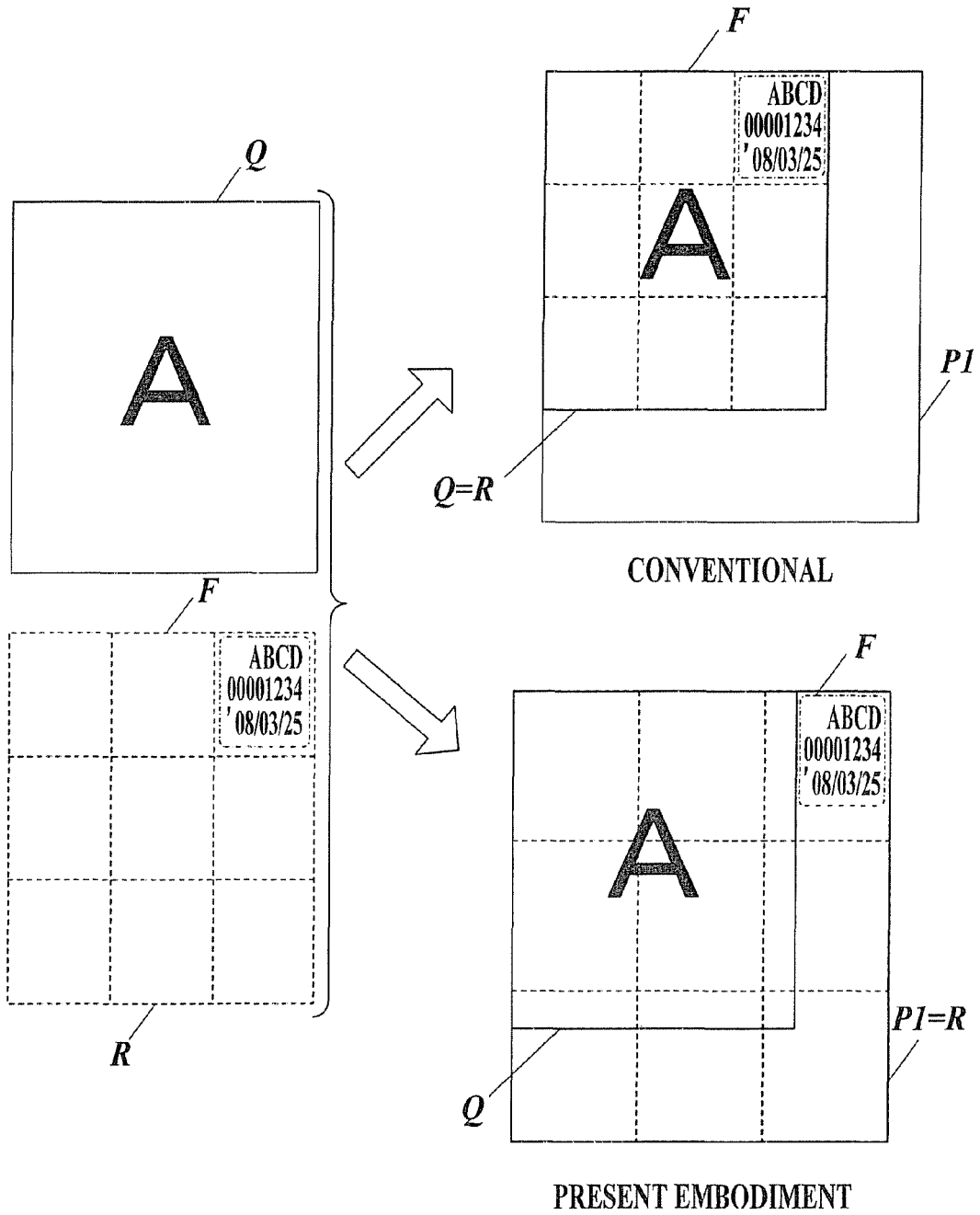
FIG. 11 is a diagram where a present embodiment is compared with a conventional additional image combining process on the basis of an input image size.

FIG. 11 shows a diagram where the present embodiment is compared with a conventional additional image combining process on the basis of the input image size. FIG. 11 shows an example of the case where the sizes of the input image Q and the sheet P1 are different from each other (for example, the input image size is A5, while the sheet size is A4), there is no sheet-cutting instruction, and the additional image position is set upper right in the image formable region R.

As shown in FIG. 11, by the conventional technique, since the additional image is formed on the basis of the size of the input image Q, the size of the input image Q is set as the image formable region R and the position where the additional image F is formed is not upper right in the sheet P1. On the other hand, according to the present embodiment, since the size of the sheet P1 is set as the image formable region R, the position where the additional image F is formed is upper right with reference to the end of the sheet P2.

Figure 12:
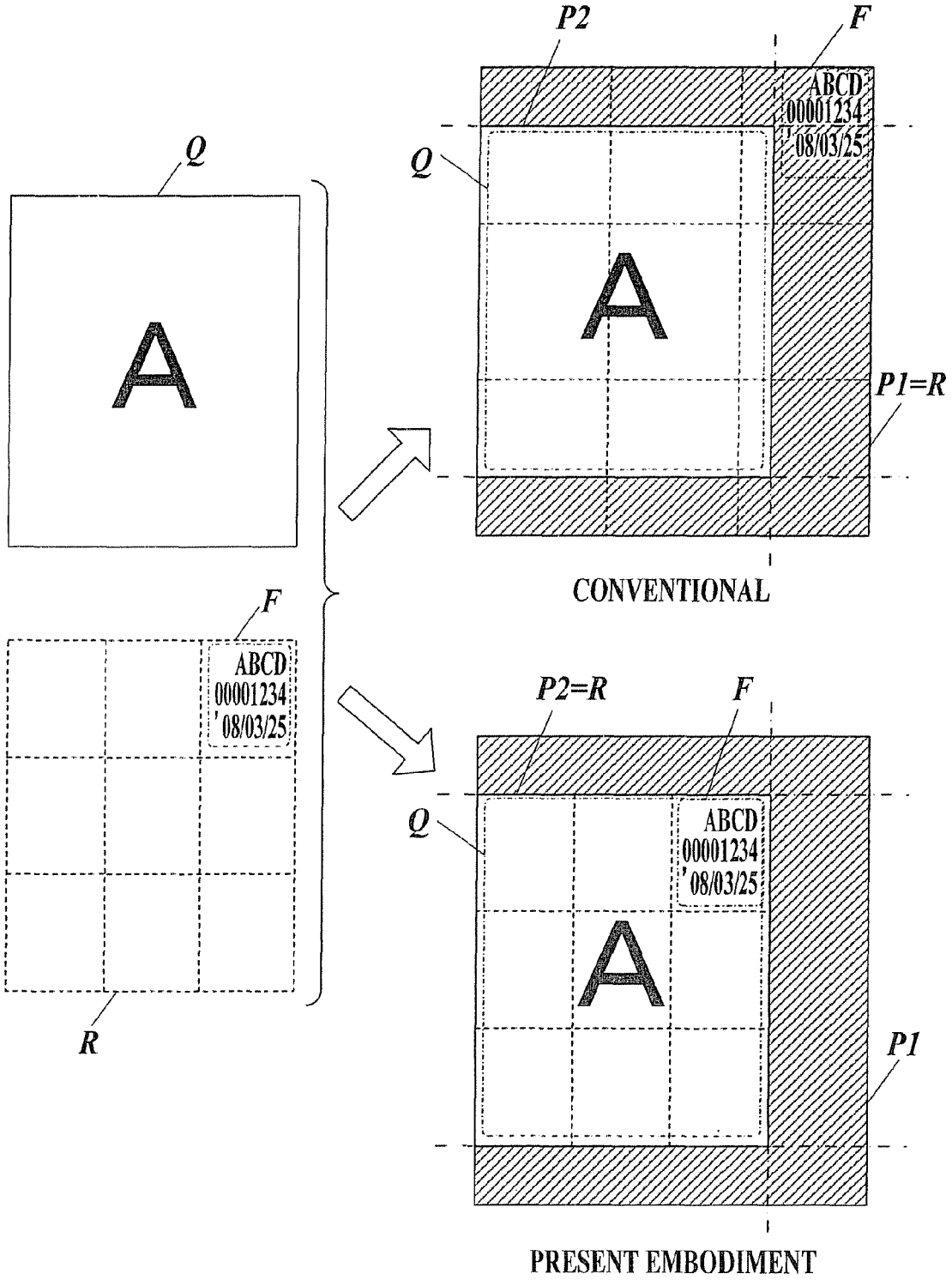
FIG. 12 is a diagram where a present embodiment is compared with a conventional additional image combining process on the basis of a size of sheet on which the image is formed.

FIG. 12 shows a diagram where the present embodiment is compared with a conventional additional image combining process on the basis of a size of sheet on which the image is formed. FIG. 12 shows an example where there is the sheet-cutting instruction and the additional image position is set upper right in the image formable region R.

As shown in FIG. 12, by the conventional technique, since the additional image is formed on the basis of the size of the sheet P1, the size of the sheet P1 is set as the image formable region R without considering the sheet-cutting position. In this case, the position where the additional image F is formed is set upper right with reference to the end of the sheet P1, but if the sheet-cutting process is performed according to the sheet-cutting position, the sheet-cutting region (shaded region in FIG. 12) including a part where the additional image is formed is cut off and there is no additional image in the sheet-cut sheet P2.

On the other hand, according to the present embodiment, since the size of the sheet P2 after sheet-cutting is set as the image formable region R based on the size of the sheet P1 and the sheet-cutting position, the position where the additional image F is formed is upper right with reference to the end of the sheet-cut sheet P2 and a part where the additional image is formed is not cut off.

As described above, according to the present embodiment, the position where the additional image is formed is set within the image formable region calculated based on the sheet-cutting position (the position based on the sheet-cutting amount or the register mark position), it is possible for user to save steps of adjusting the image forming position of the additional image in view of the sheet size after sheet-cutting, and user-friendliness is improved.

Moreover, since the sheet size after sheet-cutting can be calculated based on the sheet-cutting position when the sheet-cutting process needs to be performed, and since the sheet size not being sheet-cut can be calculated as the image formable region when the sheet-cutting process needs not to be performed, the additional image can be prevented from lacking.

Although above explanation discloses the example where the nonvolatile memory is used as a computer readable medium for the additional image combining process program according to the present embodiment, the computer readable medium is not limited to the nonvolatile memory.

As other computer readable media, a nonvolatile memory such as flash memory, portable recording medium such as CD-ROM and the like can be applied. Moreover, a medium for providing the program data according to the present embodiment through a communication line, carrier wave (carrier) can be applied to the present embodiment.

Furthermore, the present invention is not limited to the above embodiment, and can be changed properly within the spirit of the present invention.

According to one aspect of the preferred embodiment of the present invention, an image forming apparatus includes: an image forming section to form an image on a sheet based on an input image data; an additional information position instruction section to instruct a position of an additional image indicating additional information, which additional image is to be formed with the image data; a sheet-cutting position instruction section to instruct a sheet-cutting position on the sheet; and a control section to calculate an image formable region where the additional image can be formed based on the sheet-cutting position instructed by the sheet-cutting position instruction section, to set the position instructed by the additional information position instruction section within the image formable region as a position where the additional image is formed, to combine the additional image with the image data at the set position, and to control the image forming section to form the combined image data on the sheet.

According to one aspect of the preferred embodiment of the present invention, an image forming method includes: instructing a position of an additional image indicating additional information, which additional image is to be formed with the image data; instructing a sheet-cutting position on the sheet; and calculating an image formable region where the additional image can be formed based on the sheet-cutting position, setting the position instructed in the step of instructing the position of the additional image indicating the additional information within the image formable region as a position where the additional image is formed, combining the additional image with the image data at the set position, and performing a control to form the combined image data on the sheet.

In the image forming apparatus and the image forming method, since the position where the additional image is formed is set within the image formable region calculated based on the sheet-cutting position, it is possible for user to save steps of adjusting the image forming position of the additional image in view of the sheet size after sheet-cutting, and user-friendliness is improved.

Preferably, the sheet-cutting position is a position based on a sheet-cutting amount.

Moreover, the image formable region can be calculated according to the position based on the sheet-cutting amount.

Preferably, the sheet-cutting position is a position of a mark indicating the sheet-cutting position.

Moreover, the image formable region can be calculated according to the position of the mark indicating the sheet-cutting position.

Preferably, the image forming apparatus further includes: a sheet-cutting instruction section to instruct whether or not sheet-cutting process is performed to the sheet; and wherein the sheet-cutting position instruction section receives the instruction on the sheet-cutting position when there is an instruction to perform the sheet cutting process by the sheet-cutting instruction section, and the control section calculates the sheet size after sheet-cutting based on the sheet-cutting position instructed by the sheet-cutting position instruction section as the image formable region when there is the instruction to perform the sheet cutting process by the sheet-cutting instruction section, and calculates the sheet size not being sheet-cut as the image formable region when there is not the instruction to perform the sheet cutting process by the sheet-cutting instruction section.

Preferably, the image forming method further includes: instructing whether or not sheet-cutting process is performed to the sheet; and wherein in the step of instructing the sheet-cutting position on the sheet, the instruction on the sheet-cutting position is received when there is the instruction to perform the sheet-cutting process in the step of instructing whether or not the sheet-cutting process is performed to the sheet, and in the step of calculating the image formable region, the sheet size after sheet-cutting is calculated based on the sheet-cutting position instructed in the step of instructing the sheet-cutting position on the sheet as the image formable region when there is the instruction to perform the sheet cutting process in the step of instructing whether or not sheet-cutting process is performed to the sheet, and the sheet size not being sheet-cut is calculated as the image formable region when there is not the instruction to perform the sheet cutting process in the step of instructing whether or not sheet-cutting process is performed to the sheet.

Moreover, since the sheet size after sheet-cutting can be calculated based on the sheet-cutting position when the sheet-cutting process needs to be performed, and since the sheet size not being sheet-cut can be calculated as the image formable region when the sheet-cutting process needs not to be performed, the additional image can be prevented from lacking.

The present U.S. patent application claims a priority under the Paris Convention of Japanese patent application No. 2008-053283 filed on Mar. 4, 2008, which shall be a basis of correction of an incorrect translation.

What is claimed is:

1. An image forming apparatus comprising:

an image forming section to form an image on a sheet based on an input image data;

an additional information position instruction section to instruct a position of an additional image indicating additional information, which additional image is to be formed with the image data;

a sheet-cutting position instruction section to instruct a sheet-cutting position on the sheet; and a control section to calculate an image formable region where the additional image can be formed based on the sheet-cutting position instructed by the sheet-cutting position instruction section, to set the position instructed by the additional information position instruction section within the image formable region as a position where the additional image is formed, to combine the additional image with the image data at the set position, and to control the image forming section to form the combined image data on the sheet.

2. The image forming apparatus of claim 1, wherein the sheet-cutting position is a position based on a sheet-cutting amount.

3. The image forming apparatus of claim 1, wherein the sheet-cutting position is a position of a mark indicating the sheet-cutting position.

4. The image forming apparatus of claim 1 further comprising:

a sheet-cutting instruction section to instruct whether or not sheet-cutting process is performed to the sheet; and wherein the sheet-cutting position instruction section receives the instruction on the sheet-cutting position when there is an instruction to perform the sheet cutting process by the sheet-cutting instruction section, and the control section calculates the sheet size after sheet-cutting based on the sheet-cutting position instructed by the sheet-cutting position instruction section as the image formable region when there is the instruction to perform the sheet cutting process by the sheet-cutting instruction section, and calculates the sheet size not being sheet-cut as the image formable region when there is not the instruction to perform the sheet cutting process by the sheet-cutting instruction section.

5. An image forming method comprising:

instructing a position of an additional image indicating additional information, which additional image is to be formed with the image data;

instructing a sheet-cutting position on the sheet; and calculating an image formable region where the additional image can be formed based on the sheet-cutting position, setting the position instructed in the step of instructing the position of the additional image indicating the additional information within the image formable region as a position where the additional image is formed, combining the additional image with the image data at the set position, and performing a control to form the combined image data on the sheet.

6. The image forming method of claim 5 further comprising:

instructing whether or not sheet-cutting process is performed to the sheet; and wherein in the step of instructing the sheet-cutting position on the sheet, the instruction on the sheet-cutting position is received when there is the instruction to perform the sheet-cutting process in the step of instructing whether or not the sheet-cutting process is performed to the sheet, and in the step of calculating the image formable region, the sheet size after sheet-cutting is calculated based on the sheet-cutting position instructed in the step of instructing the sheet-cutting position on the sheet as the image formable region when there is the instruction to perform the sheet cutting process in the step of instructing whether or not sheet-cutting process is performed to the sheet, and the sheet size not being sheet-cut is calculated as the image formable region when there is not the instruction to perform the sheet cutting process in the step of instructing whether or not sheet-cutting process is performed to the sheet.

* * * * *